US012241145B2

(12) United States Patent
Guo et al.

(10) Patent No.: US 12,241,145 B2
(45) Date of Patent: Mar. 4, 2025

(54) ALUMINUM ALLOY AND PREPARATION METHOD AND APPLICATION THEREOF

(71) Applicant: BYD COMPANY LIMITED, Shenzhen (CN)

(72) Inventors: Qiang Guo, Shenzhen (CN); Yongliang Xie, Shenzhen (CN); Yunchun Li, Shenzhen (CN); Mengjue Liao, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 784 days.

(21) Appl. No.: 17/059,460

(22) PCT Filed: May 29, 2019

(86) PCT No.: PCT/CN2019/089075

§ 371 (c)(1),
(2) Date: Nov. 29, 2020

(87) PCT Pub. No.: WO2019/228416

PCT Pub. Date: Dec. 5, 2019

(65) Prior Publication Data

US 2021/0207249 A1 Jul. 8, 2021

(30) Foreign Application Priority Data

May 30, 2018 (CN) ..... 201810541052.8

(51) Int. Cl.

| | |
|---|---|
| ***C22C 21/02*** | (2006.01) |
| ***C22C 1/02*** | (2006.01) |
| ***C22C 1/03*** | (2006.01) |

(52) U.S. Cl.
CPC ..... *C22C 21/02* (2013.01); *C22C 1/026* (2013.01); *C22C 1/03* (2013.01)

(58) Field of Classification Search
CPC ..... C22C 1/026; C22C 1/03; C22C 1/0416; C22C 45/08; C22C 49/06; C22F 1/04; C22F 1/043; C22F 1/047; C22F 1/05; C22F 1/053; C22F 1/057; B22F 2301/052; B22D 21/007; B22D 21/04
See application file for complete search history.

(56) References Cited

U.S. PATENT DOCUMENTS

2005/0100472 A1* 5/2005 Yamada ..... C22F 1/043 148/417
2018/0087132 A1 3/2018 Park et al.

FOREIGN PATENT DOCUMENTS

| | | | | | |
|---|---|---|---|---|---|
| CN | 1607261 | A | | 4/2005 | |
| CN | 101748317 | A | | 6/2010 | |
| CN | 102312135 | B | | 1/2012 | |
| CN | 103526085 | A | * | 1/2014 | |
| CN | 104328315 | B | | 2/2015 | |
| CN | 104630581 | A | | 5/2015 | |
| CN | 104651679 | A | | 5/2015 | |
| CN | 105568080 | A | | 5/2016 | |
| CN | 106086545 | A | | 11/2016 | |
| CN | 106811630 | A | | 6/2017 | |
| CN | 107739912 | A | | 2/2018 | |
| CN | 107779695 | A | | 3/2018 | |
| FR | 2875816 | A1 | | 3/2006 | |
| JP | 2005264301 | A | | 9/2005 | |
| JP | 2006322032 | A | * | 11/2006 | |
| WO | 0071767 | A1 | | 11/2000 | |
| WO | WO-2016015488 | A1 | * | 2/2016 | ..... C22C 1/02 |

OTHER PUBLICATIONS

The World Intellectual Property Organization (WIPO) International Search Report for PCT/CN2019/089075 Aug. 23, 2019 5 Pages.

* cited by examiner

*Primary Examiner* — Ricardo D Morales
(74) *Attorney, Agent, or Firm* — Wenye Tan

(57) ABSTRACT

A die-cast aluminum alloy and a preparation method and application thereof are disclosed. Based on the total weight of the aluminum alloy, the aluminum alloy includes: 8-11 wt % of Si, 2.5-5 wt % of Cu, 0.5-1.5 wt % of Mg, 0.1-0.3 wt % of Ni, 0.6-1.2 wt % of Fe, 0.1-0.3 wt % of Cr, 0.03-0.05 wt % of Sr, 0-0.3 wt % of Er, 80.25-88.1 wt % of Al, and 0.1 wt % or below of impurities.

11 Claims, No Drawings

ALUMINUM ALLOY AND PREPARATION METHOD AND APPLICATION THEREOF

CROSS-REFERENCE TO RELATED APPLICATIONS

This application is a national phase application of International Patent Application No. PCT/CN2019/089075, filed on May 29, 2019, which is based on and claims priority to Chinese Patent Application No. 201810541052.8, entitled "ALUMINUM ALLOY AND PREPARATION METHOD AND APPLICATION THEREOF" filed with the China Patent Office on May 30, 2018. The entire disclosures of all of the above-identified applications are incorporated herein by reference.

FIELD

The present disclosure relates to the field of die-cast aluminum alloys, and specifically, to a high-strength die-cast aluminum alloy and a preparation method and application thereof.

BACKGROUND

Aluminum alloys, with the characteristics such as light weight, good toughness, corrosion resistance, and unique metallic luster, have been used in more and more parts of electronic appliances, communication devices, lighting devices, automobiles, and the like, for example, in housings of smart phones, laptops, and tablet computers, heat dissipaters and lampshades of LED lamps, heatsinks, cabinets, and filters of 3G and 4G wireless communication base stations, heating plates of rice cookers, induction cookers, and water heaters, and controller cases and drive motor housings of new energy automobiles. To meet the requirements for thin wall, light weight, high strength, and casting production of parts, the casting fluidity and mechanical properties of the aluminum alloy are increasingly demanding. At present, the most commonly used cast aluminum alloys are Al—Si cast aluminum alloys, and typical grades include ZL101, A356, A380, ADC10, ADC12, and the like. The Al—Si cast aluminum alloys usually contain 6.5% or more of Si, and therefore have good casting fluidity which meets the process requirements of casting.

The main component elements of the ADC12 material are silicon 9.6-12 wt %, copper 1.5-3.5 wt %, magnesium≤wt0.3%, zinc≤wt1.0%, iron≤wt0.9%, manganese≤wt0.5%, nickel≤wt0.5%, and tin≤wt0.3%. The ADC12 material is an Al—Si—Cu alloy, which has good die-casting formability, is suitable for fabricating thin-walled parts, and is commonly used in cylinder head covers, sensor brackets, covers, cylinder bodies and other products. However, the bulk mechanical properties of the product die-cast from the ADC12 material are ordinary, with a tensile strength of 250-280 MPa and a yield strength of 170-190 MPa, which cannot meet the high bearing capacity required by aluminum alloy die-casting products.

CN1607261A discloses a novel die-cast aluminum alloy, the main composition (weight percentage) of which is: aluminum 78-87%, silicon 10.0-14.0%, copper 2.5-4.5%, nickel 0-2.0%, manganese 0-1.5%, and the balance of less than 2.0% impurities. The contents of elements in the impurities are: iron 0-0.5%, chromium 0-0.4%, cobalt 0-0.5%, cerium 0-1.0%, lanthanum 0-1.0%, magnesium 0-0.5%, titanium 0-0.2%, zinc 0-3.0%, strontium 0-0.07%, with the weight percentage of each unspecified impurity element being less than 0.3%. The total content of nickel and manganese remains between 0.5-2.0%. The novel die-cast aluminum alloy provided by the invention has good fluidity, low cracking tendency, and good high-temperature strength, which can reduce deformation of a cast when demolding. For the die-cast aluminum alloy, the tensile strength is 45-47 ksi, the yield strength is 24-26 ksi, and the elongation (%) is 5.0-6.0 measured over a gauge length of 50 mm.

CN102312135B discloses a high-temperature aluminum alloy having a trialuminide forming a crystalline structure selected from L12, D022, and D023. The alloy substantially consists of: 0-2.0 wt % of at least one rare earth element, 0.5-14 wt % of silicon, 0.25-2.0 wt % of copper, 0.1-3.0 wt % of nickel, 0.1-1.0 wt % of iron, 0.1-2.0 wt % of zinc, 0.1-1.0 wt % of magnesium, 0-1.0 wt % of silver, 0.01-0.2 wt % of strontium, 0-1.0 wt % of manganese, 0-0.5 wt % of calcium, more than 0-0.5 wt % of germanium, 0-0.5 wt % of tin, 0-0.5 wt % of cobalt, 0-0.2 wt % of titanium, 0-0.1 wt % of boron, 0-0.3 wt % of cadmium, 0-0.3 wt % of chromium, 0-0.5 wt % of indium, at least one of scandium, zirconium, and yttrium respectively not exceeding 1.0 wt %, 0.2 wt %, and 0.5 wt %, and the balance of aluminum. The sum of amounts of copper and nickel is less than 4.0 wt %. The ratio of the amount of copper to the amount of nickel is greater than 1.5. The sum of amounts of iron and manganese is 0.5-1.5 wt %. The ratio of the amount of manganese to the amount of iron is at least 0.5. The invention requires the inclusion of zinc for improving the mechanical properties and corrosion resistance of the aluminum alloy.

CN104328315B discloses a process method for improving friction and wear performance of multi-element aluminum silicon alloys. A cast aluminum silicon alloy is first smelted into molten alloy, to which a compound refinement modifier is then added, and then treated with 0.5% of a degassing agent based on the total weight of the molten alloy. The specific chemical composition of the cast aluminum silicon alloy in percentage by mass is: Si 7-8%, Cu 3-4%, Mg 0.3-0.4%, Mn 0.2-0.3%, Zn 0.4-0.5%, Fe≤0.35%, and the balance of Al. The chemical composition of the compound refinement modifier in percentage by mass specifically is: Ti 11-13%, Cr 8-9%, Ni 9-10%, Sr 8-9%, Ce 6-7%, La 6-7%, Nb 5-6%, Pr 3.5-4%, Er 3.5-4%, Eu 3.5-4%, Y 3-3.5%, Ba 3-3.5%, B 2.5-3%, Na 2-2.5%, V 1.5-2%, and the balance of Al. Using HGJ-2 aluminum alloy sodium-free refining de-slagging de-slagging degassing agent for degassing. The alloy provided by the method contains zinc element, for the purpose of improving the friction and wear performance of the cast aluminum silicon alloy for automobile engines.

CN104630581A discloses a heat-resistant and wear-resistant aluminum alloy sliding rail, where the chemical composition of the aluminum alloy material in percentage by mass is: strontium 0.005-0.015%, silicon 15.55-15.65%, manganese 0.26-0.28%, chromium 1.71-1.73%, titanium 0.012-0.015%, zirconium 0.22-0.24%, copper 7.9-8.1%, molybdenum 0.13-0.17%, magnesium 0.08-0.16%, chromium 1.86-1.88%, tungsten 0.027-0.029%, nickel 11.5-11.7%, zinc 13.2-13.4%, iron 0.5-0.7%, rare earth 0.43-0.45%, and the balance of Al and inevitable impurities. The rare earth includes the following components in percentage by mass: neodymium 12-14%, praseodymium 3-5%, gadolinium 11-13%, erbium 16-18%, and the balance of lanthanum. The components of the aluminum alloy material disclosed by the invention require the inclusion of elements zinc, titanium, zirconium, and molybdenum for improving the toughness, weldability, and wear resistance of the aluminum alloy. In addition, the aluminum alloy product of the invention has the characteristics of resistance to high temperature, low temperature, and chemical corrosion, good processing performance, easy welding, wear resistance, long service life, and the like.

CN104651679A discloses a refractory metal-reinforced aluminum alloy material for pistons, including: silicon 10.0-25.0%, copper 1.5-6.0%, nickel 1.0-3.5%, magnesium 0.2-1.6%, iron 0.2-1.0%, titanium 0.05-0.3%, phosphorus 0-0.05%, manganese 0.05-0.6%, zirconium 0.05-0.3%, vanadium 0.05-0.3%, molybdenum 0-0.6%, tungsten 0-0.6%, niobium 0.005-0.6%, tantalum 0-0.6%, strontium 0-0.05%, and the balance of Al. The invention aims to resolve the problem that parts made of existing alloy materials cannot work in a high-temperature environment.

CN106086545A discloses an aluminum alloy, where raw materials in percentage by mass are: silicon 7.1-8.5%, copper 3.8-4.7%, iron 2.1-2.8%, zinc 1.1-1.7%, titanium 0.3-0.7%, manganese 0.6-1.3%, chromium 0.6-0.9%, cerium 0.3-0.7%, magnesium 0.35-0.41%, nickel 0.55-0.57%, strontium 0.3-0.7%, boron 0.05-0.09%, and the balance of aluminum. The composition of the aluminum alloy of the invention contains zinc for overcoming the defects in the prior art that various aluminum alloys do not have good performance in all aspects such as thermoplasticity, corrosion resistance, and heat treatment strengthening and the existing aluminum alloys have many cracks and poor elongation.

CN106811630A discloses an aluminum alloy. The aluminum alloy contains in percentage by mass: 9-12% Si, 1-2.5% Zn, 0.6-1.5% Mg, 0.3-1% Mn, and 0.5-1% Fe, 0-0.5% additional element, and 73.7-90% Al. The additional element is at least one of Ti, Zr, Cr, Cu, Bi, Ni, and Sr. The weight ratio of Mn to Mg is 0.4-0.6. The composition of the aluminum alloy of the invention contains zinc for improving the strength and thermal conductivity of the cast aluminum alloy, allowing the replacement of the expensive extrusion forming process with the cost-effective die-casting process, to obtain an aluminum alloy cast with good strength, good heat-conducting property, and low costs. The provided aluminum alloy not only has good casting performance, with a yield strength of up to 200 MPa or above, a tensile strength of up to 300 MPa or above and an elongation of up to 3% or above; but also has excellent heat-conducting property, with a thermal conductivity of up to 130 W/(m·K) or above.

CN107739912A discloses a casting process method for an aluminum silicon alloy octagonal pipe gripper assembly for automobile welding, where the composition of the aluminum silicon alloy includes (in percentage by mass): main components Al 83-95% and Si: 5-14%; and trace elements Mg 0.01-0.8%, Mn 0.01-0.8%, Ti 0.01-0.6%, Sr 0.01-0.2%, Ni 0.01-0.5%, Cr 0.01-0.5%, Cu 0.01-0.5%, and rare earth 0.01-0.2%. The aluminum silicon alloy provided by the method requires the inclusion of titanium but not iron, for resolving the problem of sudden fracture in the use of existing products. The mechanical properties of the obtained product are: tensile strength ≥300 MPa; elongation ≥3%; and hardness ≥95 HB. The mechanical properties of the aluminum silicon alloy assembly after heat treatment are much higher than 1.5 times those of the zinc aluminum alloy ZL401.

CN107779695A discloses a method for manufacturing a high-flow and corrosion-resistant chainless bicycle shell. The components in percentage are: Si 12-15; Fe 0.6-0.75; Cu 0.096-0.099; Mn 0.02-0.024; Mg 0.033-0.039; Cr 0.0042-0.0045; Ni 0.017-0.019; Zn 1.85-1.89; Ti 0.01-0.012; Ag <0.001; B 0.0021-0.0025; Ba <0.0001; Be <0.0001; Bi 0.0014-0.0018; Ca 0.0023-0.0025; Cd <0.0002; Ce <0.0015; Co <0.0005; Ga 0.02-0.025; In <0.0003; Li <0.0005; Li <0.0005; Na <0.0014; P <0.001; Pb <0.0004; Sb <0.002; Sn 0.002-0.0028; Sr <0.0001; V 0.021-0.025; Zr <0.0003; Hg <0.002; and the balance of Al. The aluminum alloy provided by the method requires the inclusion of zinc for resolving the requirements on corrosion resistance when used in a corrosive environment, and providing the fluidity of the molten alloy required by the die-casting process.

It can be seen that the prior art has made many improvements to the composition of the aluminum alloy, and the composition may contain different components to resolve different problems. However, to fabricate thin-walled parts formed by the die-casting process, aluminum alloys with particular compositions still need to be provided to meet the casting fluidity and mechanical properties of the parts.

SUMMARY

An objective of the present disclosure is to improve mechanical properties of a die-cast aluminum alloy, and provide a die-cast aluminum alloy and a preparation method and application thereof. The aluminum alloy has the advantage of high strength and is suitable for the production of aluminum alloy thin-walled parts by a die-casting method.

To achieve the above objective, a first aspect of the present disclosure provides a die-cast aluminum alloy, including, based on the total weight of the aluminum alloy: 8-11 wt % of Si, 2.5-5 wt % of Cu, 0.5-1.5 wt % of Mg, 0.1-0.3 of wt % Ni, 0.6-1.2 of wt % Fe, 0.1-0.3 of wt % Cr, 0.03-0.05 of wt % Sr, 0-0.3 wt % of Er, 80.25-88.1 wt % of Al, and 0.1 wt % or below of impurities.

In some embodiments, the weight ratio of Cu to Mg is 2.5-7:1.

A second aspect of the present disclosure provides a method for preparing the die-cast aluminum alloy of the present disclosure, including:

(1) heating to melt an aluminum ingot, and then adding an aluminum silicon alloy, an aluminum copper alloy, an aluminum magnesium alloy, an aluminum nickel alloy, an aluminum iron alloy, and an aluminum chromium alloy for a first smelting to obtain a molten alloy mixture;

(2) refining and de-slagging the molten alloy mixture, and then adding an aluminum strontium alloy and optionally an aluminum erbium alloy for a second smelting to obtain a molten aluminum alloy; and (3) cooling the molten aluminum alloy and standing to be cast into a die-cast aluminum alloy.

Preferably, step (1) includes: (1-1) heating to melt the aluminum ingot to obtain molten aluminum, and keeping the temperature of the molten aluminum at 720° C.-740° C.; and (1-2) the first smelting including: under the condition of keeping the temperature of the first smelting at 720° C.-740° C., first adding the aluminum silicon alloy, the aluminum copper alloy, and the aluminum magnesium alloy to the molten aluminum for smelting-I, and then adding the aluminum iron alloy, the aluminum nickel alloy, and the aluminum chromium alloy for smelting-II.

In some embodiments, step (2) includes: under the condition of keeping the temperature of the second smelting at 720° C.-740° C., adding the aluminum strontium alloy and the optional aluminum erbium alloy to the product obtained after the refining and de-slagging for the second smelting.

In some embodiments, in step (2), a refining agent is blown into the molten alloy mixture by nitrogen gas for the refining and de-slagging; and the refining and de-slagging time is 5-12 min.

In some embodiments, the refining agent is selected from sodium chloride and/or potassium chloride; and the amount of the refining agent is 0.2-0.4 wt % of the molten alloy mixture.

In some embodiments, in step (3), the temperature reached by cooling is 670-690° C.; and the standing time is 1-2 h.

A third aspect of the present disclosure provides application of the above die-cast aluminum alloy of the present disclosure or the die-cast aluminum alloy obtained by the above method in an aluminum alloy thin-walled part formed by die casting.

Through the above technical solutions, the die-cast aluminum alloy provided by the present disclosure, with the selected composition formed by the above elements, can provide better mechanical properties, has the casting fluidity required by the die-casting process, and is suitable for producing aluminum alloy thin-walled parts by die-casting processing, for example, key structural parts in ultra-thin mobile phones, to meet the requirements for thin wall, light weight, high strength, and casting production of parts.

Other aspects and advantages of the present disclosure will be given in the following description, some of which will become apparent from the following description or may be learned from practices of the present disclosure.

DETAILED DESCRIPTION

The endpoints and any values of the ranges disclosed herein are not limited to the precise range or value, and these ranges or values should be understood to include values close to these ranges or values. A numerical range between endpoint values of each range, a numerical range between an endpoint value and an individual point value of each range, and a numerical range between individual point values may be combined with each other to obtain one or more new numerical ranges, and such numerical ranges should be considered to be specifically disclosed herein.

A first aspect of the present disclosure provides a die-cast aluminum alloy, based on the total weight of the aluminum alloy, including: 8-11 wt % of Si, 2.5-5 wt % of Cu, 0.5-1.5 wt % of Mg, 0.1-0.3 wt % of Ni, 0.6-1.2 wt % of Fe, 0.1-0.3 wt % of Cr, 0.03-0.05 wt % of Sr, 0-0.3 wt % of Er, 80.25-88.1 wt % of Al, and 0.1 wt % or below of impurities. For example, the content of Si is 8 wt %, 8.2 wt %, 8.4 wt %, 8.6 wt %, 8.8 wt %, 9 wt %, 9.2 wt %, 9.4 wt %, 9.6 wt %, 9.8 wt %, 10 wt %, 10.2 wt %, 10.4 wt %, 10.6 wt %, 10.8 wt %, or 11 wt %. The content of Cu is 2.5 wt %, 2.7 wt %, 2.9 wt %, 3.1 wt %, 3.3 wt %, 3.5 wt %, 3.7 wt %, 3.9 wt %, 4.1 wt %, 4.3 wt %, 4.5 wt %, 4.7 wt %, 4.9 wt %, or 5 wt %. The content of Mg is 0.5 wt %, 0.7 wt %, 0.9 wt %, 1.1 wt %, 1.3 wt %, or 1.5 wt %. The content of Ni is 0.1 wt %, 0.2 wt %, or 0.3 wt %. The content of Fe is 0.6 wt %, 0.7 wt %, 0.8 wt %, 0.9 wt %, 1.0 wt %, 1.1 wt %, or 1.2 wt %. The content of Cr is 0.1 wt %, 0.2 wt %, or 0.3 wt %. The content of Sr is 0.03 wt %, 0.04 wt %, or 0.05 wt %. The content of Er is 0 wt %, 0.1 wt %, 0.2 wt %, or 0.3 wt %. The content of Al is 80.25 wt %, 80.5 wt %, 80.75 wt %, 81 wt %, 81.25 wt %, 81.5 wt %, 81.75 wt %, 82 wt %, 82.25 wt %, 82.5 wt %, 82.75 wt %, 83 wt %, 83.25 wt %, 83.5 wt %, 83.75 wt %, 84 wt %, 84.25 wt %, 84.5 wt %, 84.75 wt %, 85 wt %, 85.25 wt %, 85.5 wt %, 85.75 wt %, 86 wt %, 86.25 wt %, 86.5 wt %, 86.75 wt %, 87 wt %, 87.25 wt %, 87.5 wt %, 87.75 wt %, 88 wt %, or 88.1 wt %.

When including the elements with the above contents, the die-cast aluminum alloy provided by the present disclosure can provide the casting fluidity and the mechanical properties of alloys required by the die-casting process, thereby meeting the requirements of manufacture of thin-walled parts.

The die-cast aluminum alloy provided by the present disclosure contains the above elements and has certain contents so as to resolve the technical problems to be solved by the present disclosure. Silicon can help improve the forming fluidity of the alloy material, increase the alloy hardness, increase the strength and corrosion resistance of the alloy, reduce the shrinkage, and reduce the hot cracking tendency. The silicon with the above content can bond with other elements.

Copper within the above content range added to the die-cast aluminum alloy provided by the present disclosure can bond with aluminum to form an $Al_2Cu$ phase, which helps improve the fluidity, tensile strength, and hardness of the alloy. A good strengthening effect may be achieved when the copper content in the aluminum alloy is within the above range.

Magnesium within the above content range contained in the die-cast aluminum alloy provided by the present disclosure can bond with Si to form a $Mg_2Si$ phase, thereby increasing the mechanical properties (tensile strength and hardness) of the material, and improving the corrosion resistance of the material.

A small amount of iron added to the die-cast aluminum alloy provided by the present disclosure can improve the phenomenon that the die-cast aluminum alloy is not easy to be released from the mold, and reduce erosion of the mold by the aluminum alloy. When the iron content is within the above specified range, the iron can bond with other components in the alloy. In the die-cast aluminum alloy of the present disclosure, if the iron content exceeds 1.2 wt %, there are defects such as reduced alloy fluidity, impaired quality of the cast, and shortened service life of metal parts in the die-casting equipment.

Nickel within the above content range added to the die-cast aluminum alloy provided by the present disclosure can bond with other components in the alloy, which improves the strength and hardness of the alloy, and can reduce the corrosion of the mold by the alloy, neutralize harmful effects of iron, and improve weldability of the alloy.

Chromium within the above content range added to the die-cast aluminum alloy provided by the present disclosure can bond with aluminum to form intermetallic compounds such as $(CrFe)Al_7$ and $(CrMn)Al_{12}$ in the aluminum, to hinder the nucleation and growth processes of recrystallization, thereby providing a certain strengthening effect for the alloy, improving the toughness of the alloy, and reducing susceptibility to stress corrosion cracking. In the die-cast aluminum alloy of the present disclosure, if the chromium content exceeds 0.3 wt %, the defect of increased susceptibility to quenching of the material is caused.

Erbium within the above content range may be optionally added to the die-cast aluminum alloy provided by the present disclosure. The added erbium can bond with aluminum to form $Al_3Er$ particles during alloy solidification to increase the nucleation rate. The $Al_3Er$ particles and $\alpha$-Al have crystal structures with the same matrix and close lattice constants, which can effectively refine $\alpha$-Al grains of the alloy and improve the tensile strength of the alloy. In the die-cast aluminum alloy of the present disclosure, if the erbium content is too high and exceeds 0.3 wt %, the grain refinement effect is weakened.

In the die-cast aluminum alloy provided by the present disclosure, the added strontium within the above content range can be used as a surface active element to change the behavior of intermetallic compound phases. The added strontium can bond with other elements in the alloy, which has the characteristics of long effective time for modification, and good effects and reproducibility, can improve the mechanical properties and plastic workability of the obtained die-cast aluminum alloy, and can improve the thermal conductivity of the material.

According to the present disclosure, preferably, the aluminum alloy includes: 9-10 wt % Si, 3-4 wt % Cu, 0.6-1 wt % Mg, 0.1-0.3 wt % Ni, 0.6-1 wt % Fe, 0.1-0.3 wt % Cr, 0.03-0.05 wt % Sr, 0.1-0.25 wt % Er, 83-86.1 wt % Al, and 0.1 wt % or below of impurities.

In the present disclosure, the specified impurity content in the provided die-cast aluminum alloy is low. The impurities may be Ti, Zn, Ni, or other elements.

The die-cast aluminum alloy provided by the present disclosure includes a combination of multiple elements, of which the contents are within the specified ranges. Preferably, the die-cast aluminum alloy consists of the elements with the above contents. More preferably, copper and magnesium can be used in combination with each other to provide better casting fluidity and mechanical properties for the die-cast aluminum alloy. The weight ratio of Cu to Mg is 2.5-7:1, such as 2.5:1, 3:1, 3.5:1, 4:1, 4.5:1, 5:1, 5.5:1, 6:1, 6.5:1, or 7:1.

The die-cast aluminum alloy provided by the present disclosure can provide the casting fluidity and mechanical properties required by preparing thin-walled parts by the die-casting method. For the die-cast aluminum alloy, the yield strength is >220 MPa, the tensile strength is >300 MPa, and the elongation is >1.4%. The casting fluidity can be evaluated by a length testing method using a die-casting mosquito coil mold, and the length of the die-cast aluminum alloy provided by the present disclosure as measured by the test using a die-casting mosquito coil mold may be greater than 1375 mm.

A second aspect of the present disclosure provides a method for preparing the die-cast aluminum alloy of the present disclosure, including:

(1) heating to melt an aluminum ingot, and then adding an aluminum silicon alloy, an aluminum copper alloy, an aluminum magnesium alloy, an aluminum nickel alloy, an aluminum iron alloy, and an aluminum chromium alloy for a first smelting to obtain a molten alloy mixture;

(2) refining and de-slagging the molten alloy mixture, and then adding an aluminum strontium alloy and optionally an aluminum erbium alloy for a second smelting to obtain a molten aluminum alloy; and (3) cooling the molten aluminum alloy and standing to be cast into a die-cast aluminum alloy.

The method for preparing the die-cast aluminum alloy in the present disclosure is implemented by smelting various raw materials containing the above elements. Preferably, step (1) includes: (1-1) heating to melt the aluminum ingot to obtain molten aluminum, and keeping the temperature of the molten aluminum at 720° C.-740° C., such as 720° C., 722° C., 724° C., 726° C., 728° C., 730° C., 732° C., 734° C., 736° C., 738° C., or 740° C.; and (1-2) the first smelting including: under the condition of keeping the temperature of the first smelting at 720° C.-740° C., for example, 720° C., 722° C., 724° C., 726° C., 728° C., 730° C., 732° C., 734° C., 736° C., 738° C., or 740° C., first adding the aluminum silicon alloy, the aluminum copper alloy, and the aluminum magnesium alloy to the molten aluminum for smelting-I, and then adding the aluminum iron alloy, the aluminum nickel alloy, and the aluminum chromium alloy for smelting-II.

In the preparation method provided by the present invention, in step (2), the molten alloy mixture is further refined, and the required elements are added. Preferably, step (2) includes: under the condition of keeping the temperature of the second smelting at 720° C.-740° C., for example, 720° C., 722° C., 724° C., 726° C., 728° C., 730° C., 732° C., 734° C., 736° C., 738° C., or 740° C., adding the aluminum strontium alloy and the optional aluminum erbium alloy to the product obtained after the refining and de-slagging for the second smelting.

According to the present disclosure, a refining agent may be added during the refining. Preferably, in step (2), the refining agent is blown into the molten alloy mixture by nitrogen gas for the refining and de-slagging; and the refining and de-slagging time is 5-12 min, for example, 5 min, 6 min, 7 min, 8 min, 9 min, 10 min, 11 min or 12 min.

According to the present disclosure, the impurities can be better removed using the refining agent. The refining agent may be a refining agent commonly used in the art. Preferably, the refining agent is selected from at least one of sodium chloride and potassium chloride; and the amount of the refining agent is 0.2-0.4 wt % of the molten alloy mixture, such as 0.2 wt %, 0.22 wt %, 0.24 wt %, 0.26 wt %, 0.28 wt %, 0.3 wt %, 0.32 wt %, 0.34 wt %, 0.36 wt %, 0.38 wt %, or 0.4 wt %, and preferably 0.3 wt %.

In the preparation method provided by the present invention, in step (3), the obtained molten aluminum alloy is further treated to obtain the product. Preferably, in step (3), the temperature after cooling is 670-690° C., for example, 670° C., 672° C., 674° C., 676° C., 678° C., 680° C., 682° C., 684° C., 686° C., 688° C., or 690° C.; and the standing time is 1-2 h, for example, 1 h, 1.2 h, 1.4 h, 1.6 h, 1.8 h, or 2 h. Such a condition is conducive to obtaining the aluminum alloy with good casting fluidity and mechanical properties.

In the present disclosure, through the above preparation steps, the elements composing the die-cast aluminum alloy can be more uniformly mixed, and the impurity content in the obtained die-cast aluminum alloy is low, which may be less than 0.1 wt %.

According to the present disclosure, the die-cast aluminum alloy may be prepared using various materials containing the required elements, which may be the various alloys described above, and may be commercially available. Preferably, the aluminum ingot may be a commercially available aluminum ingot with an aluminum content of about 99.99 wt %. The aluminum silicon alloy may be an Al-20Si alloy. The aluminum copper alloy may be an Al-50Cu alloy. The aluminum magnesium alloy may be an aluminum alloy containing 3-5 wt % magnesium. The aluminum nickel alloy may be a commercially available Al-10Ni alloy. The aluminum iron alloy may be a commercially available Al-20Fe alloy. The aluminum chromium alloy may be a commercially available Al-10Cr alloy. The aluminum strontium alloy may be a commercially available Al-10Sr alloy. The aluminum erbium alloy may be a commercially available Al-10Er alloy.

A third aspect of the present disclosure provides application of the above die-cast aluminum alloy of the present disclosure or the die-cast aluminum alloy obtained by the above method in an aluminum alloy thin-walled part formed by die casting.

The application may be but is not limited to various thin-walled parts required in electronic appliances, communication devices, lighting devices, and automobiles, for example, in housings of smart phones, laptops, and tablet computers, heat dissipaters and lampshades of LED lamps, heatsinks, cabinets, and filters of 3G and 4G wireless communication base stations, heating plates of rice cookers, induction cookers, and water heaters, and controller cases and drive motor housings of new energy automobiles.

The disclosure is described in detail below by using various embodiments as examples.

In the following embodiments and comparative embodiments, the raw materials used are all commercially available.

The mechanical properties of the prepared aluminum alloy are measured according to the methods in GB/T 228.1-2010. Three tensile specimens are given, and the average value is taken as the result of the tensile test.

The casting fluidity of the prepared aluminum alloy is evaluated according to a length testing method using a die-casting mosquito coil mold: 120 g of molten aluminum alloy (680° C.) is added to the mosquito coil mold at a pressure of 12-14 MPa, and the length by which the melt extends in the flow channel is measured. The mosquito coil mold has a strip flow channel disk in a shape of a mosquito coil disk with a cross section of 5.6 mm×3.0 mm, and the entrance is in the center of the mosquito coil mold.

Embodiment 1

The composition and weight percentage of the prepared high-strength die-cast aluminum alloy were as follows:

Si 9.0 wt %, Cu 4.0 wt %, Mg 1.0 wt %, Ni 0.2 wt %, Fe 0.6 wt %, Cr 0.2 wt %, Sr 0.03 wt %, Er 0.2 wt %, 0.1 wt % or below of impurities, and the balance of Al. The weight ratio of Cu:Mg was 4:1.

According to the above composition, an aluminum ingot, an aluminum silicon alloy, an aluminum copper alloy, an aluminum magnesium alloy, an aluminum iron alloy, an aluminum nickel alloy, an aluminum chromium alloy, an aluminum strontium alloy, and an aluminum erbium alloy were prepared.

(1) The aluminum ingot was heated to be melted to obtain molten aluminum, and the temperature was kept at about 720° C.

The aluminum silicon alloy, the aluminum copper alloy, and the aluminum magnesium alloy were added to the molten aluminum for smelting-I, and the temperature was kept at about 720° C.

The aluminum iron alloy, the aluminum nickel alloy, and the aluminum chromium alloy were added for smelting-II, and the temperature was kept at about 720° C. to obtain a molten alloy mixture.

(2) Sodium chloride as the refining agent which was 0.3 wt % of the molten alloy mixture was blown into the molten alloy mixture by nitrogen gas, and the refining and de-slagging were carried out at the temperature of about 720° C. for about 12 min until the refining was finished; and then the aluminum strontium alloy and the aluminum erbium alloy were added to the product obtained after the refining and de-slagging, and the second smelting was carried out at about 720° C. to obtain a molten aluminum alloy.

(3) The molten aluminum alloy was cooled down to 690° C., and then stood for 1 h, to be cast into a die-cast aluminum alloy.

Embodiment 2

The composition and weight percentage of the prepared high-strength die-cast aluminum alloy were as follows:

Si 10.0 wt %, Cu 2.5 wt %, Mg 1.0 wt %, Ni 0.2 wt %, Fe 0.6 wt %, Cr 0.2 wt %, Sr 0.03 wt %, Er 0.1 wt %, 0.1 wt % or below of impurities, and the balance of Al. The weight ratio of Cu:Mg was 2.5:1.

According to the above composition, an aluminum ingot, an aluminum silicon alloy, an aluminum copper alloy, an aluminum magnesium alloy, an aluminum iron alloy, an aluminum nickel alloy, an aluminum chromium alloy, an aluminum strontium alloy, and an aluminum erbium alloy were prepared.

(1) The aluminum ingot was heated to be melted to obtain the molten aluminum, and the temperature was kept at about 730° C.

The aluminum silicon alloy, the aluminum copper alloy, and the aluminum magnesium alloy were added to the molten aluminum for smelting-I, and the temperature was kept at about 740° C.

The aluminum iron alloy, the aluminum nickel alloy, and the aluminum chromium alloy were added for smelting-II, and the temperature was kept at about 720° C. to obtain a molten alloy mixture.

(2) Potassium chloride as the refining agent which was 0.2 wt % of the molten alloy mixture was blown into the molten alloy mixture by nitrogen gas, and the refining and de-slagging were carried out at the temperature of about 720° C. for about 10 min until the refining was finished; and then the aluminum strontium alloy and the aluminum erbium alloy were added to the product obtained after the refining and de-slagging, and the second smelting was carried out at about 740° C. to obtain a molten aluminum alloy.

(3) The molten aluminum alloy was cooled down to 670° C., and then stood for 2 h, to be cast into a die-cast aluminum alloy.

Embodiment 3

The composition and weight percentage of the prepared high-strength die-cast aluminum alloy were as follows:

Si 9.5 wt %, Cu 3 wt %, Mg 0.8 wt %, Ni 0.2 wt %, Fe 0.6 wt %, Cr 0.2 wt %, Sr 0.03 wt %, Er 0.25 wt %, 0.1 wt % or below of impurities, and the balance of Al. The weight ratio of Cu:Mg was 3.75:1.

According to the above composition, an aluminum ingot, an aluminum silicon alloy, an aluminum copper alloy, an aluminum magnesium alloy, an aluminum iron alloy, an aluminum nickel alloy, an aluminum chromium alloy, an aluminum strontium alloy, and an aluminum erbium alloy were prepared.

(1) The aluminum ingot was heated to be melted to obtain the molten aluminum, and the temperature was kept at about 740° C.

The aluminum silicon alloy, the aluminum copper alloy, and the aluminum magnesium alloy were added to the molten aluminum for smelting-I, and the temperature was kept at about 740° C.

The aluminum iron alloy, the aluminum nickel alloy, and the aluminum chromium alloy were added for smelting-II, and the temperature was kept at about 740° C. to obtain a molten alloy mixture.

(2) Sodium chloride as the refining agent which was 0.4 wt % of the molten alloy mixture was blown into the molten alloy mixture by nitrogen gas, and the refining and de-slagging were carried out at the temperature of about 740° C. for about 5 min until the refining was finished; and then the aluminum strontium alloy and the aluminum erbium alloy were added to the product obtained after the refining and de-slagging, and the second smelting was carried out at about 740° C. to obtain a molten aluminum alloy.

(3) The molten aluminum alloy was cooled down to 680° C., and then stood for 1.5 h, to be cast into a die-cast aluminum alloy.

Embodiment 4

The composition and weight percentage of the prepared high-strength die-cast aluminum alloy were as follows:

Si 9.0 wt %, Cu 4.0 wt %, Mg 1.0 wt %, Ni 0.2 wt %, Fe 0.6 wt %, Cr 0.2 wt %, Sr 0.03 wt %, 0.1 wt % or below of impurities, and the balance of Al. The weight ratio of Cu:Mg was 4:1.

According to the above composition, an aluminum ingot, an aluminum silicon alloy, an aluminum copper alloy, an aluminum magnesium alloy, an aluminum iron alloy, an aluminum nickel alloy, an aluminum chromium alloy, an aluminum strontium alloy, and an aluminum erbium alloy were prepared.

(1) The aluminum ingot was heated to be melted to obtain the molten aluminum, and the temperature was kept at about 720° C.

The aluminum silicon alloy, the aluminum copper alloy, and the aluminum magnesium alloy were added to the molten aluminum for smelting-I, and the temperature was kept at about 720° C. The aluminum iron alloy, the aluminum nickel alloy, and the aluminum chromium alloy were added for smelting-II, and the temperature was kept at about 720° C. to obtain a molten alloy mixture.

(2) Sodium chloride as the refining agent which was 0.3 wt % of the molten alloy mixture was blown into the molten alloy mixture by nitrogen gas, and the refining and de-slagging were carried out at the temperature of about 720° C. for about 12 min until the refining was finished; and then the aluminum strontium alloy was added to the product obtained after the refining and de-slagging, and the second smelting was carried out at about 720° C. to obtain a molten aluminum alloy.

(3) The molten aluminum alloy was cooled down to 690° C., and then stood for 1 h, to be cast into a die-cast aluminum alloy.

Embodiment 5

The composition and weight percentage of the prepared high-strength die-cast aluminum alloy were as follows:

Si 9.0 wt %, Cu 3.0 wt %, Mg 1.5 wt %, Ni 0.2 wt %, Fe 0.6 wt %, Cr 0.2 wt %, Sr 0.03 wt %, Er 0.2 wt %, 0.1 wt % or below of impurities, and the balance of Al. The weight ratio of Cu:Mg was 2:1.

According to the above composition, an aluminum ingot, an aluminum silicon alloy, an aluminum copper alloy, an aluminum magnesium alloy, an aluminum iron alloy, an aluminum nickel alloy, an aluminum chromium alloy, an aluminum strontium alloy, and an aluminum erbium alloy were prepared.

(1) The aluminum ingot was heated to be melted to obtain the molten aluminum, and the temperature was kept at about 720° C.

The aluminum silicon alloy, the aluminum copper alloy, and the aluminum magnesium alloy were added to the molten aluminum for smelting-I, and the temperature was kept at about 720° C.

The aluminum iron alloy, the aluminum nickel alloy, and the aluminum chromium alloy were added for smelting-II, and the temperature was kept at about 720° C. to obtain a molten alloy mixture.

(2) Sodium chloride as the refining agent which was 0.3 wt % of the molten alloy mixture was blown into the molten alloy mixture by nitrogen gas, and the refining and de-slagging were carried out at the temperature of about 720° C. for about 12 min until the refining was finished; and then the aluminum strontium alloy and the aluminum erbium alloy were added to the product obtained after the refining and de-slagging, and the second smelting was carried out at about 720° C. to obtain a molten aluminum alloy.

(3) The molten aluminum alloy was cooled down to 690° C., and then stood for 1 h, to be cast into a die-cast aluminum alloy.

Comparative Embodiment 1

ADC12, the component content of which was: silicon 10.5 wt %, copper 1.6 wt %, magnesium 0.2 wt %, zinc 0.3 wt %, iron 0.7 wt %, manganese 0.2 wt %, nickel 0.2 wt %, and tin 0.15 wt %.

Tensile Test

The mechanical property test was carried out on the aluminum alloys of Embodiments 1-5 and Comparative Embodiment 1 according to GB/T 228.1-2010. Three tensile specimens were measured for each aluminum alloy, and the average value was taken as the result of the tensile test.

According to the test method using a die-casting mosquito coil mold, under the same die-casting process conditions, the lengths of die-casting mosquito coil molds fabricated from the aluminum alloys of Embodiments 1-5 and Comparative Embodiment 1 were measured. The results are as shown in Table 1.

TABLE 1

| No. | Yield strength, MPa | Tensile strength, MPa | Elongation, % | Length, mm |
|---|---|---|---|---|
| Embodiment 1 | 237 | 320 | 1.61 | 1450 |
| Embodiment 2 | 227 | 310 | 1.42 | 1408 |
| Embodiment 3 | 230 | 315 | 1.52 | 1392 |
| Embodiment 4 | 220 | 297 | 1.45 | 1385 |
| Embodiment 5 | 223 | 300 | 1.39 | 1375 |
| Comparative Embodiment 1 | 181 | 284 | 1.85 | 1360 |

As can be seen from the results of the embodiments, comparative embodiments, and Table 1, the embodiments using the technical solutions of the present disclosure can obtain die-cast aluminum alloys with good casting fluidity, the length measured by the test method using a die-casting mosquito coil mold was greater than 1375 mm, while the length obtained in the comparative embodiment was only 1360 mm. In addition, the obtained die-cast aluminum alloy had high strength, with a yield strength of greater than 220 MPa and a tensile strength of greater than 300 MPa, which can be used for preparing thin-walled parts by die-casting. Moreover, the obtained die-cast aluminum alloy can meet the requirements on the elongation of the prepared product. For example, the elongation of a mobile phone case product is not less than 1%.

The preferred embodiments of the present disclosure are described in detail above with reference to the accompanying drawings, but the present disclosure is not limited to the specific details in the above embodiments. Various simple variations may be made to the technical solutions of the present disclosure within the scope of the technical idea of the present disclosure, and such simple variations shall all fall within the protection scope of the present disclosure.

It should be further noted that the specific technical features described in the above specific embodiments may be combined in any suitable manner without contradiction. To avoid unnecessary repetition, various possible combinations are not further described in the present disclosure.

In addition, various different implementations of the present disclosure may alternatively be combined randomly. Such combinations should also be considered as the content disclosed in the present disclosure provided that these combinations do not depart from the concept of the present disclosure.

In the descriptions of this specification, descriptions using reference terms "an embodiment", "some embodiments", "an example", "a specific example", or "some examples" mean that specific characteristics, structures, materials, or features described with reference to the embodiment or example are included in at least one embodiment or example of the present disclosure. In this specification, exemplary descriptions of the foregoing terms do not necessarily refer to a same embodiment or example. In addition, the described specific features, structures, materials, or characteristics may be combined in an appropriate manner in any one or more embodiments or examples. In addition, with no conflict, a person skilled in the art can integrate and combine different embodiments or examples and features of the different embodiments and examples described in this specification.

Although the embodiments of the present disclosure are shown and described above, it can be understood that, the foregoing embodiments are exemplary, and cannot be construed as a limitation to the present disclosure. Within the scope of the present disclosure, a person of ordinary skill in the art may make changes, modifications, replacements, and variations to the foregoing embodiments.

What is claimed is:

1. A die-cast aluminum alloy, consisting of, based on the total weight of the aluminum alloy:

9-10 wt % of Si;
3-4 wt % of Cu;
0.6-1 wt % of Mg;
0.1-0.3 wt % of Ni;
0.6-1 wt % of Fe;
0.1-0.3 wt % of Cr;
0.03-0.05 wt % of Sr;
0.1-0.25 wt % of Er;
0.1 wt % or below of impurities; and
the balance of Al.

2. A method for preparing the die-cast aluminum alloy according to claim 1, comprising:

(1) heating to melt an aluminum ingot, and then adding an aluminum silicon alloy, an aluminum copper alloy, an aluminum magnesium alloy, an aluminum nickel alloy, an aluminum iron alloy, and an aluminum chromium alloy for a first smelting to obtain a molten alloy mixture;

(2) refining and de-slagging the molten alloy mixture, and then adding an aluminum strontium alloy and optionally an aluminum erbium alloy for a second smelting to obtain a molten aluminum alloy; and (3) cooling the molten aluminum alloy and standing to be cast into a die-cast aluminum alloy.

3. The method according to claim 2, wherein step (1) comprises:

(1-1) heating to melt the aluminum ingot to obtain molten aluminum, and keeping the temperature of the molten aluminum at 720° C.-740° C.; and (1-2) the first smelting comprising: under the condition of keeping the temperature of the first smelting at 720° C.-740° C., first adding the aluminum silicon alloy, the aluminum copper alloy, and the aluminum magnesium alloy to the molten aluminum for smelting-I, and then adding the aluminum iron alloy, the aluminum nickel alloy, and the aluminum chromium alloy for smelting-II.

4. The method according to claim 3, wherein step (2) comprises:

under the condition of keeping the temperature of the second smelting at 720° C.-740° C., adding the aluminum strontium alloy and the optional aluminum erbium alloy to the product obtained after the refining and de-slagging for the second smelting.

5. The method according to claim 2, wherein in step (2), a refining agent is blown into the molten alloy mixture by nitrogen gas for the refining and de-slagging; and the refining and de-slagging time is 5-12 min.

6. The method according to claim 1, wherein the refining agent is selected from at least one of sodium chloride and potassium chloride; and the amount of the refining agent is 0.2-0.4 wt % of the molten alloy mixture.

7. The method according to claim 2, wherein in step (3), the temperature after cooling is 670-690° C.; and the standing time is 1-2 h.

8. The aluminum alloy according to claim 1, wherein a weight ratio of Cu to Mg is around 4:1.

9. The aluminum alloy according to claim 1, wherein a weight ratio of Cu to Mg is around 2.5:1.

10. The aluminum alloy according to claim 1, wherein a weight ratio of Cu to Mg is around 3.75:1.

11. The aluminum alloy according to claim 1, wherein a weight ratio of Cu to Mg is 2.5-7:1.

* * * * *